United States Patent [19]

Lindner et al.

[11] 4,043,153

[45] Aug. 23, 1977

[54] SLIDING LATCH NEEDLE

[75] Inventors: Heinz Lindner, Geyer, Erzg; Dieter Happel, Karl-Marx-Stadt, both of Germany

[73] Assignee: VEB Wirkmaschinenbau Karl-Marx-Stadt, Karl-Marx-Stadt, Germany

[21] Appl. No.: 602,621

[22] Filed: Aug. 7, 1975

[30] Foreign Application Priority Data

Sept. 4, 1974 Germany ..... 4180887

[51] Int. Cl.[2] ..... D04B 35/06

[52] U.S. Cl. ..... 66/120

[58] Field of Search ..... 66/120, 13, 62

[56] References Cited

U.S. PATENT DOCUMENTS

| | | | |
|---|---|---|---|
| 1,461,007 | 7/1923 | Taft | 66/120 |
| 1,673,634 | 6/1928 | Page | 66/13 |
| 1,790,611 | 1/1931 | Vitoux | 66/120 X |
| 2,373,533 | 4/1945 | Bolden et al. | 66/120 |
| 2,393,931 | 1/1946 | Peel | 66/120 |
| 2,775,108 | 12/1956 | Bellini | 66/120 |
| 2,778,211 | 1/1957 | Rhoads | 66/120 |
| 2,796,606 | 6/1957 | Amidon et al. | 66/120 |
| 3,229,485 | 1/1966 | Peschl et al. | 66/120 |
| 3,584,481 | 6/1971 | Hayashi | 66/120 |
| 3,811,299 | 5/1974 | Peschl et al. | 66/120 |

FOREIGN PATENT DOCUMENTS

| | | | |
|---|---|---|---|
| 1,374,722 | 8/1964 | France | 66/120 |
| 2,146,981 | 4/1972 | Germany | 66/120 |
| 47-7746 | 4/1972 | Japan | 66/120 |
| 954,565 | 4/1964 | United Kingdom | 66/120 |

*Primary Examiner*—Mervin Stein
*Assistant Examiner*—Andrew M. Falik
*Attorney, Agent, or Firm*—Nolte and Nolte

[57] ABSTRACT

A loop-controlled slide needle for the forming of loops by a loop forming textile machine, comprising a shaft, a hook integral with one end of the shaft, the hook having a tapered free end, the shaft tapering in the plane of the hook at the juncture of the shaft and the hook, a longitudinal groove formed in the shaft, and a slide bar slidably mounted in the groove for movement between one position in which the slide bar closes the hook and another position in which the slide bar leaves the hook open, the slide bar having an end which faces the free end of the hook and which has a recess for receiving the tapered end of the hook when the hook is closed by the slide bar.

5 Claims, 8 Drawing Figures

1
2
3
4
5
6
7
8
9
10
11
12
13
14
15
16
17
18
IV
IV

SLIDING LATCH NEEDLE

The present invention relates to a slide needle for loop forming textile machines, such as knitting, warp knitting, sew knitting, Galon crocheting and the like machines.

More particularly, in the slide needles of the invention, the entry to the hook is followed by an obliquely rising surface defining the juncture of the needle shaft with the hook and by a longitudinal groove in the shaft, the groove being open upwardly. In the longitudinal groove is provided a slide bar which at least partly protrudes above the groove. Reciprocation of the slide bar in the groove is limited by at least one longitudinal slot in the slide-bar in combination with a cross pin which is fixedly connected to the needle shaft and passes through the longitudinal slot. The slide bar is guided in such a way that the hook is closed by the slide bar in one end position of the reciprocation of the needle and is open in the other position of the reciprocation of the needle. Toward its end remote from the hook and protruding above the groove of the needle shaft, the slide bar is provided with a recess, into which recess the last formed loop slides when the needle is at the foremost position of its reciprocation, in order to prevent a premature closure by the slide bar.

The terms "rising," "upwardly" and the like as used herein assume a horizontal orientation of the needle with the hook lying in a vertical plane with the entry to the hook being accessible from the top of the shaft but not from the bottom of the shaft. However, it is not intended thereby to limit the scope of the patent to the use of the needle in that particular orientation.

Loop-controlled slide needles for loop forming textile machines are already known in which during the motion of the needle the slide bars are reciprocated between the closure position and the opening position only by the formed thread loops on the needle shaft. No control means are needed for these slide needles in order to move the slide bars or closure wires or the like for an orderly production of closed loops. German Democratic Republic Pat. No. 17,377 discloses such a slide needle in which a slide bar is slidingly mounted in a longitudinal hole and a slot. French Pat. No. 1,374,722 discloses such a slide needle in which the slide bar, retained by guiding means, may be reciprocated in such a way, that the slide bar in one end position closes the hook and in the other end position opens the hook so that a thread may be introduced.

Finally, German Democratic Republic Pat. Nos. 88,039 and 93,971 disclose a slide needle in which portions of the slide bar located respectively forwardly and rearwardly of the groove are each provided with a recess. This construction has the advantage that the loop which was formed last slips into the rear recess while the slide needle moves, thereby holding back the slide bar during the forward motion of the slide needle whereby a premature closing of the hook by the slide-bar is prevented. The very last loop formed slips into the forward recess immediately before the knocking over, so that the slide bar is held in the closed position until the formed loop drops off over the needle point.

The great disadvantage of the first mentioned slide needle is the great expense of manufacturing it. The needles may not properly form the loops due to malfunctioning of the needles. The location of the hole for the slide and adequately precise guidance of the slide in the hole demand a complicated technology of manufacture.

For the second mentioned slide needle, again the expense of manufacturing is considerable, and loop formation again may not be reliable. Faulty loops or breaks in the thread may occur because the needles are provided with V-shaped profiles including sharp ends over which the bights of the loops must slide. This disadvantage is increased further by the pressure occurring due to the taking up of the fabric. Not the bight of a loop which is to be knocked over brings the slide bar into the closing position, but the slide bar reaches that position at high working speeds due to its own moment of inertia. As a result, it is impossible to insert a new thread segment into the hook, which causes the occurrence of flaws in the fabric. Disadvantageous jamming of the slide bars in the needleshaft also occurs due to the development of misalignments between the guidance means and the slide bars.

These disadvantages are avoided in the last mentioned slide needles. However, in the closure position of the slide bar, the needle point is not fully covered, which tends to lead to breaks in the thread. This disadvantage occurs particularly with texturized threads which contain many interstices.

Therefore, objects of the present invention are to provide a slide needle with the use of which there can be obtained a flaw-free fabric comprised of thread loops even when processing voluminous threads containing many interstices, thereby to increase productivity and also to free the operator from the task of repairing thread breaks. Other objects and advantages of the invention will be apparent to one skilled in the art from the following description of the invention.

According to the present invention, there is provided a slide needle for loop forming textile machines, such as knitting, warp knitting, sew knitting, galoon crocheting and the like machines, which is easily manufactured, and which, furthermore, ensures an orderly process of loop forming without thread breaks.

According to the present invention, the needle point, which tapers along its length beginning near its end, may be closed in the closure position of the slide bar by an oppositely shaped recess in the slide bar, which oppositely shaped recess extends upwardly beyond the height of the tapered end of the needle point.

According to a first embodiment of the present invention, the slide bar consists preferably of two longitudinal parts, which are joined with the forward free end of each thereof being bent laterally outwardly so as to define the aforementioned recess which receives the tapered end of the needle point in the closed position of the slide relative to the needle. A recess is provided in each lateral wall of the groove in the needle shaft in which the slide bar slides in the area of motion of the spread front ends of the slide bar parts, that is, near the front end of the groove, in order to ensure the unhindered sliding of the slide bar.

According to a further embodiment of the present invention, the slide bar is a combination of three longitudinal parts, the front ends of which are so shaped so that when the parts are joined the front ends together define the aforementioned recess which receives the tapered end of the point of the needle when the needle is closed by the slide bar.

According to a further feature of the present invention, the front end of the top face of the slide bar is beveled so that its slopes toward the needle point. This ensures complete and reliable knocking over of the thread loop which has been formed. Another feature is that additional guiding means are provided in the needle shaft above the slide bar. Yet another feature of the present invention is that the aforementioned guiding means consist of a cross pin which limits the upward movement of the slide bar.

The use of a slide needle according to the present invention avoids breaking of thread while loops are being formed and thereby increases the productivity of the process of loop manufacture.

The invention is further described hereinbelow by reference to specific embodiments thereof as illustrated in the drawings, in which.

Figures 1, 2, 3, 4:
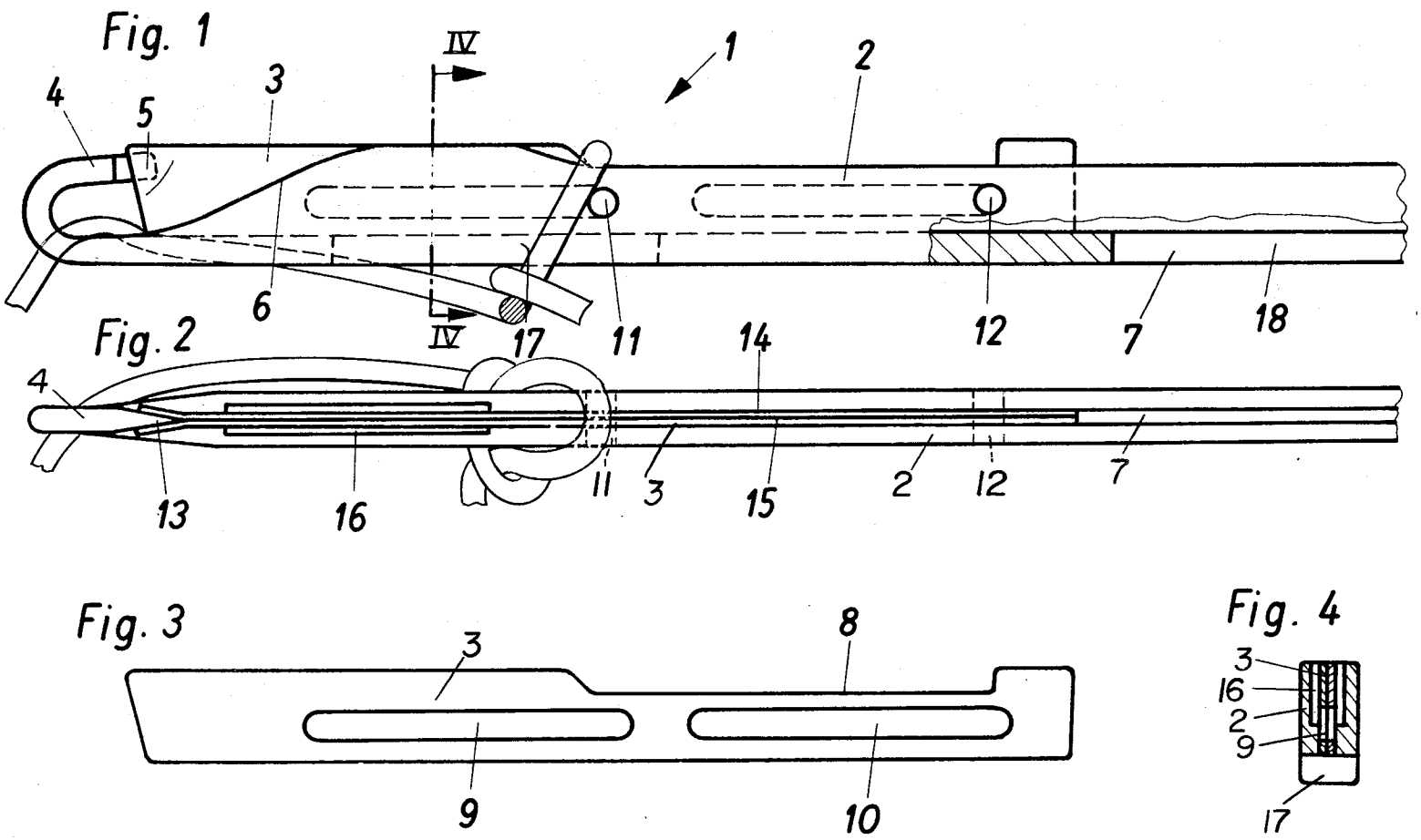
FIG. 1 is a partly cut away side elevation of a slide needle according to the invention.
FIG. 2 is a plan view of the needle of FIG. 1.
FIG. 3 is a side elevation of the slide bar of the embodiment of FIGS. 1 and 2.
FIG. 4 is a section along the line IV—IV in FIG. 1.
Figures 5, 6, 7, 8:
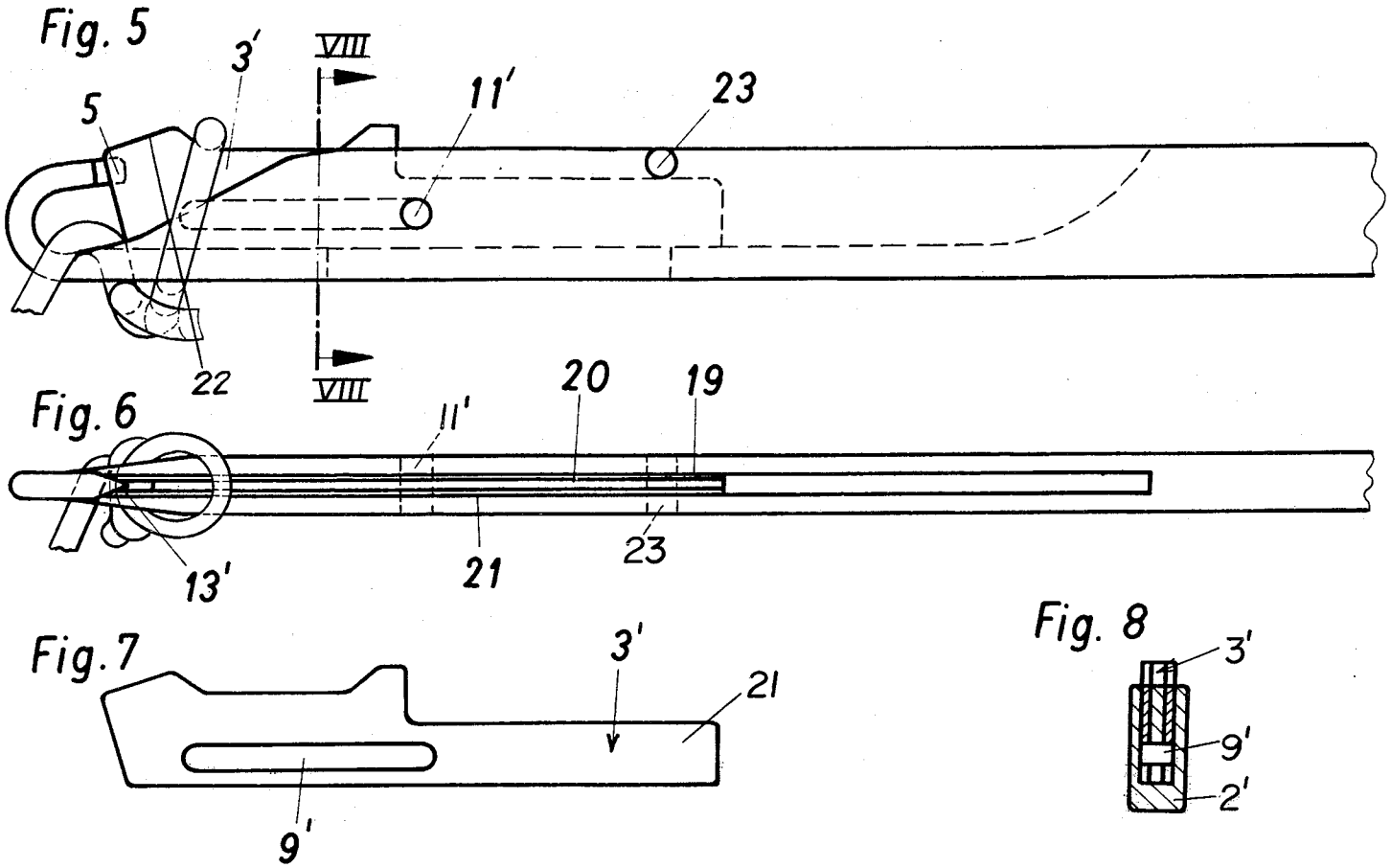
FIG. 5 is a side elevation of another slide needle embodying the present invention.
FIG. 6 is a plan view of the needle of FIG. 5.
FIG. 7 is a side elevation of the slide bar of the embodiments of FIGS. 6 and 7.
FIG. 8 is a section along the line VIII—VIII in FIG. 5.

The slide needle 1 consists of a needle shaft 2 and a slide bar 3 (FIG. 1). A needle hook 4 is provided at the front end of the needle shaft 2, the needle hook 4 forming at its rearwardly tapered free end, a needle point 5. Extending rearwardly from the rear end of the needle hook 4 is an obliquely rising surface 6 defining the front end of the needle shaft 2. The longitudinal groove 7, within which groove the slide bar 3 is movably guided begins in the surface 6. Toward the rear end of the slide bar 3 a recess 8 is provided into which the last formed loop slips when the slide needle 1 is at the foremost position of its reciprocation. Thus, the loop which was just formed prevents a premature closing of the hook by the slide bar, and the new thread segment for the forming of a loop can be introduced without any difficulty.

In the embodiment of FIGS. 1 to 4, two longitudinal slots 9 and 10 are provided in the slide bar 3. These longitudinal slots 9, 10 are traversed and thereby longitudinally slidably fastened to the needle shaft 2 (not shown in FIG. 4) by the cross pins 11, 12 which are fixed to the needle shaft 2.

The end of the needle point 5 tapers and points toward the rear of the slide needle 1 substantially parallel to the axis of the shaft 2 and can be closed by the slide bar 3 which is provided with an oppositely shaped recess 13 with which the needle point 5 mates when the slide bar 3 closes the needle hook 4.

The height of the slide bar 3 and the recess therein is greater than the height of the needle hook 4 and the needle point 5. Consequently, the slide bar 3 fully covers the needle point 5 so that the thread loops will not be caught on the needle point 5 as they are being knocked off the needle 1.

As can be seen in FIG. 3, the slide bar 3 is shaped with its front face sloped downwardly toward the rear of the needle. In order to simplify the manufacture of the slide bar 3, it consists of two longitudinal parts 14, 15. A recess 16 is provided in the walls of the groove in the needle shaft 2 in the area of motion of the diverging front ends of the parts 14, 15, which diverging front ends define the recess into which is received the needle point 5 when the slide bar 3 closes the needle hook 4. The bottom of the longitudinal groove 7 is provided with recesses 17, 18 which serve for the ejection of lint and other dirt particles.

In the embodiment of FIGS. 5 to 8, the slide bar 3' consists of three longitudinal parts 19, 20, 21, and the front ends of the parts form the acute angled recess 13', the recess being like that in the embodiment of FIGS. 1 to 4 and serving the same purpose. The front end of the top face of the slide bar 3' is provided with a bevel 22, in order to facilitate knocking over of the thread loops formed. The guiding means used for the slide bar 3' in this embodiment consists of a longitudinal hole 9' in combination with a crosspin 11' fixed to the needle shaft 2 and a cross pin 23 fixed to the needle shaft 2 above the slide bar 3.

The slide needle of the invention ensures an orderly production of loops, and thread breaks are avoided even for threads containing many interstices.

What is claimed is:

1. A loop-controlled slide needle for the forming of loops in loop forming textile machines, comprising a shaft, a hook integral with one end of the shaft, the hook having a rearwardly tapered free end, the shaft forwardly tapering in the plane of the hook at the juncture of the shaft and the hook and providing a rearwardly and upwardly extending surface from below said tapered free end, a longitudinal groove formed in the shaft, and a slide bar slidably mounted in the groove for movement between one position in which the slide bar closes the hook and another position in which the slide bar leaves the hook open, said slide bar having an end extending from the bottom of the groove when positioned therein to above said tapered free end of said hook and which faces the rearwardly tapering free end of the hook and which has a hook receiving recess at the upper portion of its forwardly facing end for receiving the rearwardly tapered end of the hook when the hook is closed by the slide bar, said slide bar having at least one longitudinal slot therein, a pin fixed to the shaft and received in the slot for limiting the sliding of the slide bar in the groove, at least part of the length of the slide bar protruding above the groove, said slide bar, at a location remote from the end of the slide bar facing the tapered end of the hook, providing a loop receiving recess extending along its upper surface for receiving the last formed loop when the slide bar is retracted and the hook is therefore open, thereby to prevent premature closing of the hook by the slide bar, said slide bar comprising at least two flat-sided longitudinal members connected together with a flat side of each juxtaposed to a flat side of each other the respective forwardly facing ends of the members at the upper portions thereof nearer the hook being formed to diverge forwardly from each other thereby to define the recess in the slide bar and means are provided in the shaft above the slide bar for guiding the slide.

2. A loop-controlled slide needle for the forming of loops in loop forming textile machines, comprising a shaft, a hook integral with one end of the shaft, the hook having a rearwardly tapered free end, the shaft forwardly tapering in the plane of the hook at the juncture of the shaft and the hook and providing a rearwardly and upwardly extending surface from below said tapered free end, a longitudinal groove formed in the shaft, and a slide bar slidably mounted in the groove for movement between one position in which the slide bar closes the hook and another position in which the slide bar leaves the hook open, said slide bar having an end extending above said tapered free end of said hook and which faces the free end of the hook and which has a hook receiving recess for receiving the tapered end of the hook when the hook is closed by the slide bar, said slide bar having at least one longitudinal slot therein, a pin fixed to the shaft and received in the slot for limiting the sliding of the slide bar in the groove, at least part of the length of the slide bar protruding above the groove, said slide bar, at a location remote from the end of the slide bar facing the tapered end of the hook, providing a loop receiving recess for receiving the last formed loop when the slide bar is retracted and the hook is therefore open, thereby to prevent premature closing of the hook by the slide bar, comprising three flat sided longitudinal members connected together with a flat side of each lying against a flat side of another, at the end of the slide bar nearer the hook the middle one of the three members terminating at a location further from the hook than the location at which the other members terminate thereby to define the recess in the slide bar.

3. A slide needle according to claim 1, in which the slide bar extends beyond the free end of the hook in the plane of the hook and the top edge of the slide bar continuous with the end of the slide bar facing the free end of the hook slopes toward the free end of the hook.

4. A slide needle according to claim 2, further comprising means for guiding the slide bar arranged in the shaft above a portion of the slide bar.

5. A slide needle according to claim 4, in which the guiding means comprises a pin fixed to the shaft and engaging the top edge of said portion of the slide bar.

* * * * *